US005839712A

United States Patent [19]

Wang

[11] Patent Number: 5,839,712

[45] Date of Patent: Nov. 24, 1998

[54] PEN HOLDER FOR VERTICAL AND HORIZONTAL HOLD

[76] Inventor: Chin-Chi Wang, 35-4, Lu Ti Street, Pan Chiao City, Taipei Hsien, Taiwan

[21] Appl. No.: 825,745

[22] Filed: Apr. 3, 1997

[51] Int. Cl.[6] ..... A47F 7/00

[52] U.S. Cl. ..... 248/316.2; 211/69.5; 211/69.6; 403/4

[58] Field of Search ..... 248/316.2, 316.7, 248/316.1, 309.1, 176.1; 211/69.5, 69.1, 69.6, 69.7; 403/3, 4, 164

[56] References Cited

U.S. PATENT DOCUMENTS

| | | | |
|---|---|---|---|
| 1,745,799 | 2/1930 | Johnson et al. | 211/69.6 |
| 1,916,808 | 7/1933 | Parker | 211/69.5 |
| 3,810,550 | 5/1974 | Longarzo | 211/69.6 |
| 4,643,604 | 2/1987 | Enrico | 211/69.5 X |
| 4,865,285 | 9/1989 | Gaggianese | 211/69.1 X |
| 4,934,527 | 6/1990 | Ho | 211/69.5 X |

FOREIGN PATENT DOCUMENTS

| | | | |
|---|---|---|---|
| 718216 | 1/1932 | France | 211/69.6 |

*Primary Examiner*—Ramon O. Ramirez
*Assistant Examiner*—Long Dinh Phan
*Attorney, Agent, or Firm*—Burns, Doane, Swecker & Mathis, L.L.P.

[57] ABSTRACT

The present invention relates to a pen holder for holding a pen of variable diameter in a vertical or horizontal position, where the insertion part is rotatable against the base for convenient use. The present invention comprises a base and an insertion part, which is vertically rotatably mounted on the base and is made of two halves, the two halves being glidable against each other and, being pressed against each other by two springs, holding the pen in between in a vertical or a horizontal channel.

8 Claims, 4 Drawing Sheets

PEN HOLDER FOR VERTICAL AND HORIZONTAL HOLD

BACKGROUND OF THE INVENTION

1. Field of the Invention

The present invention relates to a pen holder for holding a pen of variable diameter in a vertical or horizontal position, where the insertion part is rotatable against the base for convenient use.

2. Description of Related Art

Conventional pen holders come in many variations, basically, there are two types: holders where a pen is inserted vertically and holders where a pen is held fast horizontally. The first type includes note or card holders with an additional insertion hole for a pen as well as elongated casings for a pen with a ball-shaped lower end, sitting on a base and adjustable in its direction. The second type includes grooves of an elastic material with a suction cup. However, there are no pen holders capable of holding a pen both vertically and horizontally as well as being rotatable in all directions. Furthermore, conventional pen holders cannot accommodate pens of higher diameter, like marker pens, crayons or pens for flip charts.

SUMMARY OF THE INVENTION

The main object of the present invention is to provide a pen holder for holding a pen of variable diameter in a vertical or horizontal position, where the insertion part is rotatable against the base.

Another object of the present invention is to provide a pen holder, where rotating the insertion part produces a clear clicking noise, indicating the positioning of the pen.

A further object of the present invention is to provide a pen holder, which accommodates a pen with any of various diameters, like a pencil, a crayon or a marker pen.

A further object of the present invention is to provide a pen holder, to which a chain is attachable to connect to the pen and secure it against being lost.

A further object of the present invention is to provide a pen holder, which is by adhesive tape or magnet attachable to a base plate, like a table, a counter or the inner wall of a car.

A further object of the present invention is to provide a pen holder, which allows to print a company name or logo on the surface on its base for advertising purposes.

The present invention can be more fully understood by reference to the following description and accompanying drawings.

DETAILED DESCRIPTION OF THE PREFERRED EMBODIMENT

Figure 1:
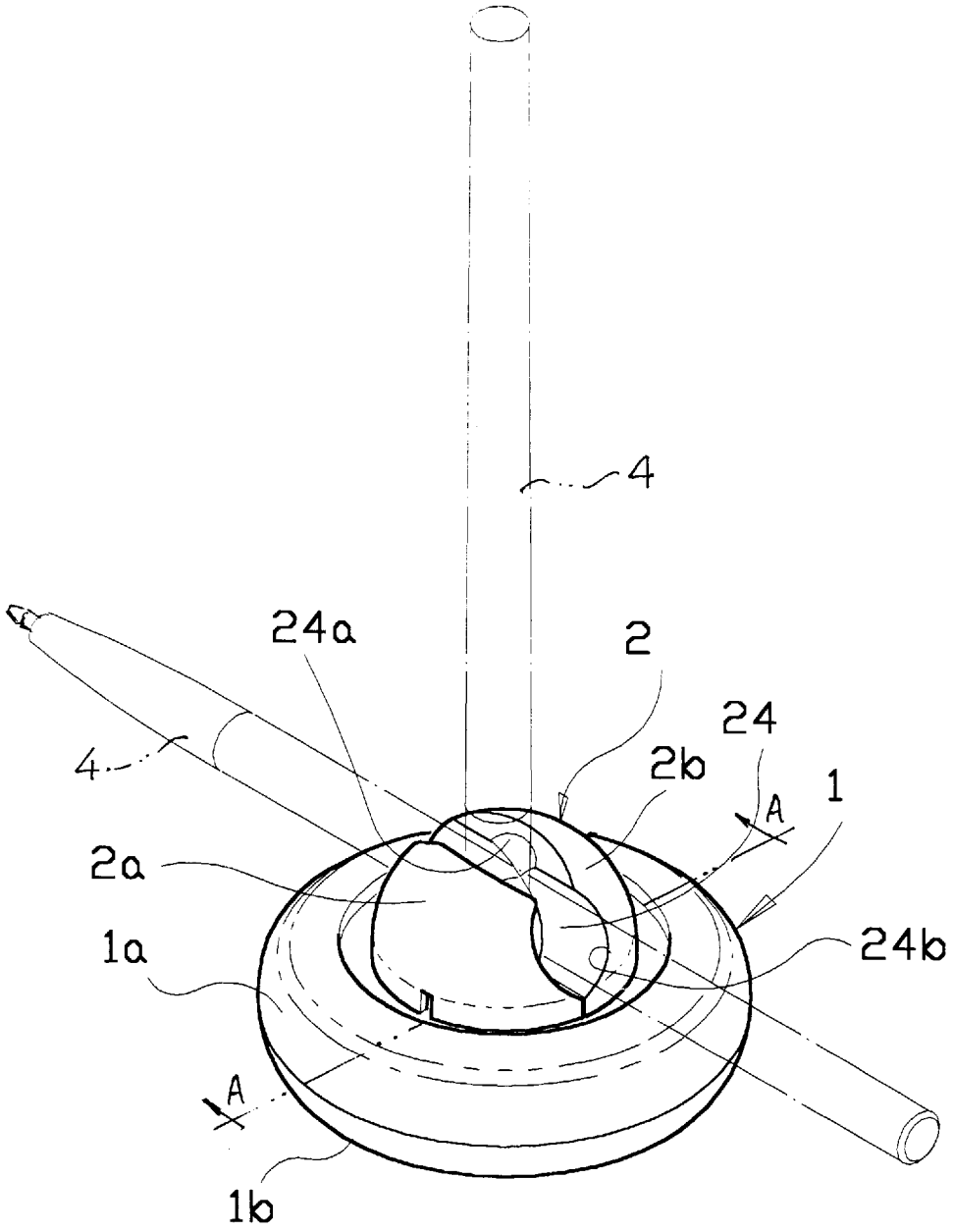
FIG.1 is a perspective view of the pen holder of the present invention.
Figure 2:
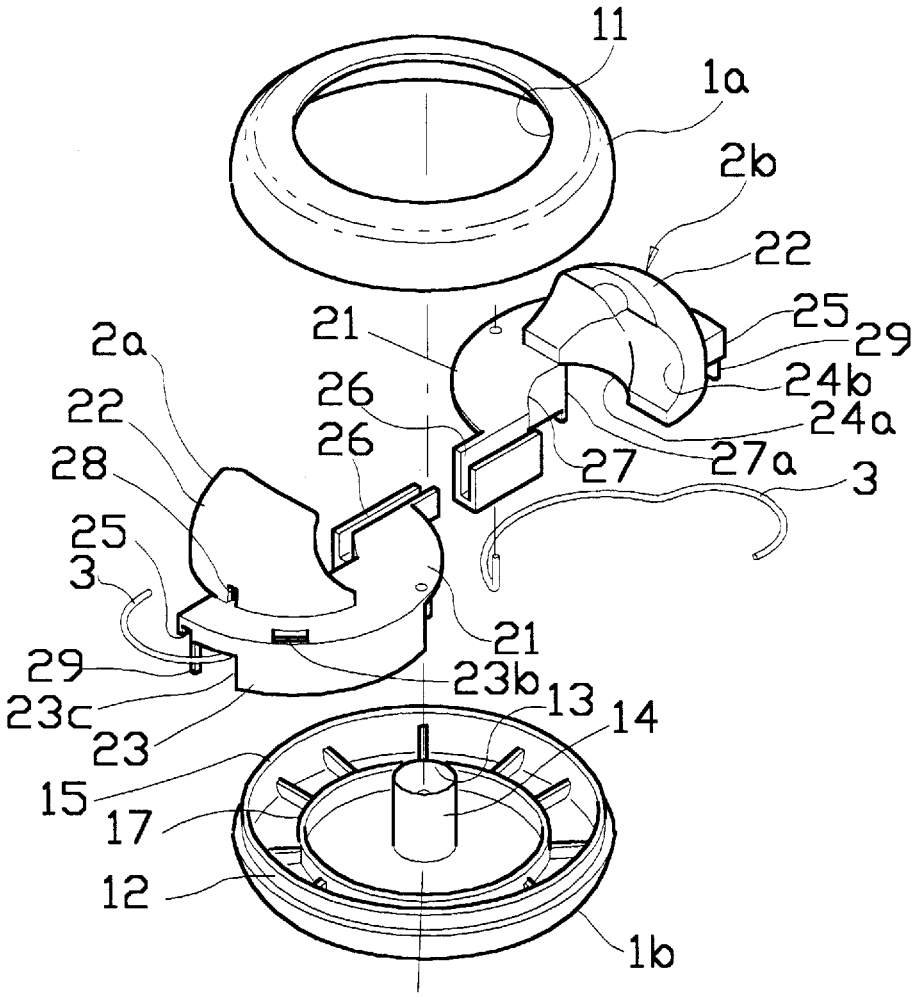
FIG. 2 is an exploded view of the pen holder of the present invention.
Figure 3:
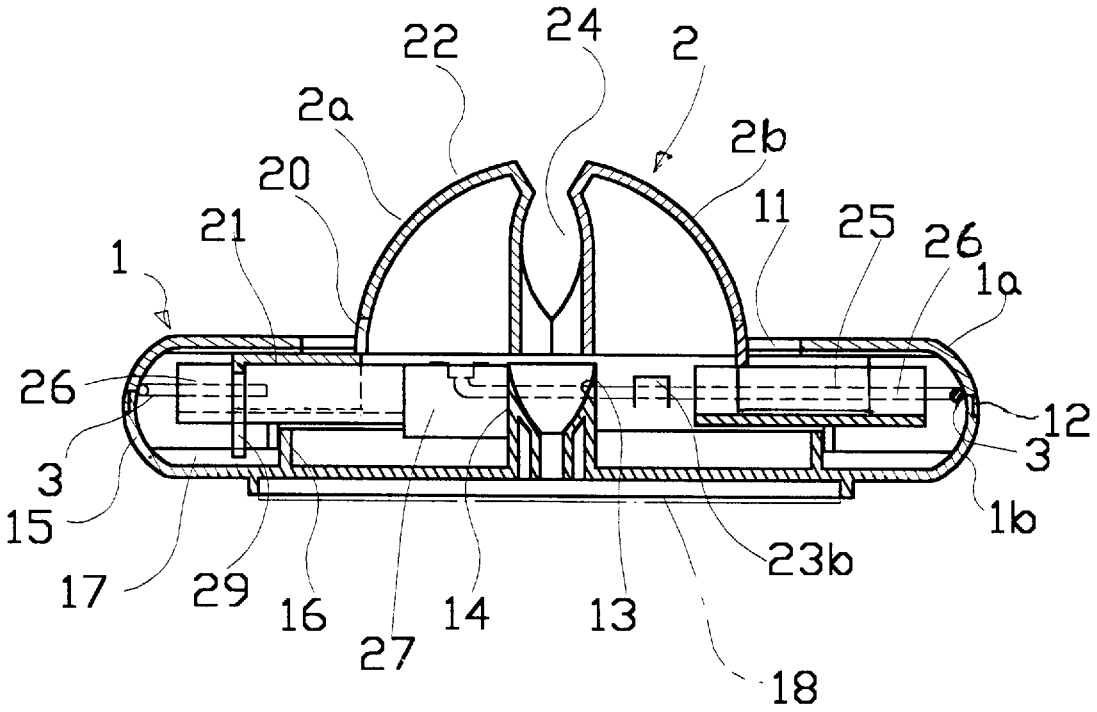
FIG. 3 is a longitudinal sectional view of the present invention, taken along the line A—A of FIG. 1.
Figure 4:
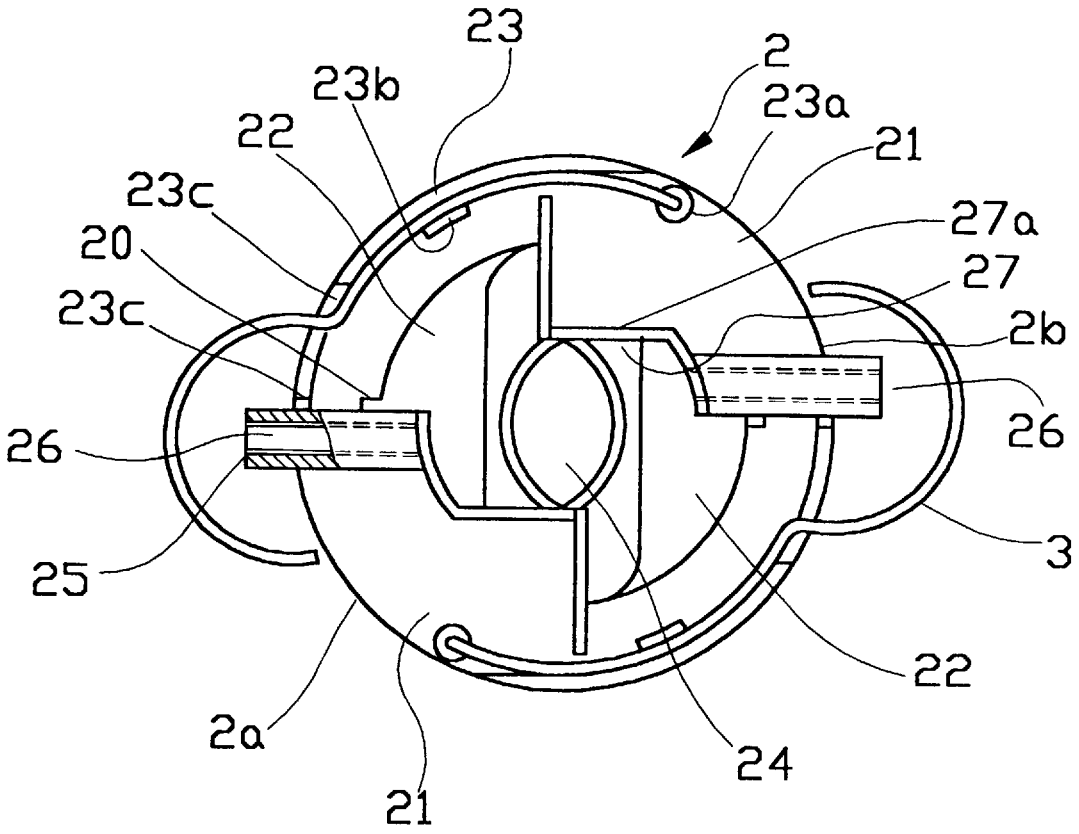
FIG. 4 is a planar view of the present invention, taken from below.

Referring to FIGS. 1 and 2, the pen holder of the present invention mainly comprises a base 1 and an insertion part 2, which is mounted on the base 1 and rotatable around a vertical axis.

The base 1 is shaped like a torus. It has an upper part 1*a* and a lower part 1*b*, of which each resembles a pan, the upper part 1*a* resembling a pan turned upside down with a concentric hole 11. The lower part 1*b* has a periphery 15. Along the periphery 15, a connecting rim 12 extends upwards, where the upper part 1*a* is attached to form a whole. From the bottom of the lower part 1*b*, a hollow cylindrical shaft 14 extends upwards, which is concentric with the lower part 1*b*, with an inner hole 13 for centering the insertion part 2. Concentrically around the shaft 14, inside the periphery 15, a support rim 16 extends upwards from the bottom of the lower part 1*b*. A plurality of radial ribs 17 connect the support rim 16 to the periphery 15. The bottom of the lower part 1*b* is attachable to a base plate by adhesive tape or a magnet.

The insertion part 2 comprises two equal halves 2*a*, 2*b*. Each half 2*a*, 2*b* in turn is made of a half plate 21 and a half ball 22. The half plate 21 has an upper side, which is shaped like a half circle, with a longitudinal axis along the straight line of the half circle and a horizontal transversal axis perpendicular thereto. From the upper side of the half plate 21, a peripheral edge 23 extends downwards. On the upper side of the half plate 21, the half ball 22 is attached. The half ball 22 has a polar axis parallel to the longitudinal axis and a roughly concave surface perpendicular thereto. Into the concave surface two grooves 24*a*, 24*b* are cut. Groove 24*a* is parallel to the vertical, groove 24*b* is parallel to the transversal axis. The straight section of the peripheral edge 23 of the half plate 21 along the longitudinal axis has on one end a rail 25 and on the other end a guiding groove 26, both parallel to the longitudinal axis. The rail 25 of each half plate 21 fits into the guiding groove 26 of the other half plate 21. In each half plate 21, the rail 25 faces the convex side of the half ball 22, and the guiding groove 26 faces the concave side of the half ball 22. A vertical connecting plate 27*a* connects the guiding groove 26 to a projecting part 27 besides the groove 24*a* on the concave side of the half ball 22. The half ball 22 below the groove 24*b*, besides the half plate 21 has a lower extension 28. The halves 2*a* and 2*b* of the insertion part 2 contact each other, such that the upper sides of the two half plates 21 form a full circle, with the concave sides of the two half balls 22 facing each other. The thus assembled insertion part 2 is rotatably inserted into the bottom part 1*b*.

In each half plate 21, the rail 25 has a downward extending elastic protrusion 29. Inside the peripheral edge 23, a spring 3, shaped like the numeral 3, is inserted. Furthermore, the upper side of the half plate close to the periphery has a fixing hole 23*a*. The peripheral edge 23 has a holding part 23*b* on its inner side and a opening 23*c* close to the rail 25. The spring 3 is laid horizontally along the inner side of the peripheral edge 23, held by the holding part 23*b*, then passes through the opening 23*c* and continues in an outward curved arc, surrounding the guiding groove 26. The other end of the spring 3 passes through the fixing hole 23*a*. There is an elongated hole 20 close to the lower side of the half sphere 22, so as to pass through a cord or a chain to connect to the pen.

The assembly of the parts of the present invention is as follows. First, one end of the spring 3 is laid into the fixing hole 23*a*. Then the middle part of the spring is laid along the inner side of the peripheral edge 23 and fixed to the holding part 23*b*. The other end of the spring passes through the opening 23*c*. The springs 3 of the two halves 2*a*, 2*b* of the insertion part 2 are mounted in the same way. After that, the two halves 2*a*, 2*b* are put together. This is done in a way that the rail 25 of each half 2*a*, 2*b* is inserted into the guiding groove 26 of the other half 2*b*, 2*a* and that the concave sides of both half balls 22 touch each other. Then the grooves 24*a* of both halves 2*a*, 2*b* and the grooves 24*b* of both halves 2*a*, 2*b* form vertical and horizontal channels 24, respectively. The thus assembled insertion part 2 is put over the shaft 14 of the bottom part 1*b*. Then the guiding grooves 26 rest on the support rim 16. The lower extensions 28 and the peripheral edges 23 sit on the ring-like area between the shaft 14 and the support rim 16. The elastic protrusions 29 extend into the space between pairs of the radial ribs 17. The springs 3 press against the inner side of the periphery 15, such that both halves 2*a*, 2*b* are radially pressed inwards and lean against each other. So the channels 24, in which the pen is to be held, stay narrow. Finally, the upper part 1*a* is attached to or screwed on the lower part 1*b* at the connecting rim 12.

To use the pen holder of this invention, the bottom side of the lower part is attached to a base plate by adhesive tape or a magnet. A pen is inserted in the horizontal or vertical channel 24. The springs 3 ensure that even a thin pen is held fast. On the other hand, since the two halves 2*a*, 2*b* of the insertion part 2 are outward movable, the channels also accommodate thick pens. When the pen holder is attached to a vertical wall, like the side wall of a freezer, the pen is inserted in the horizontal channel and will not occupy valuable space. In the horizontal channel, the pen can be turned in any angular position. When turning the insertion part 2, the blocking protrusions 29 glide over the radial ribs 17 with a well noticeable noise and resistance, adding to the sensual perception of using the present invention. Moreover, in order not to get lost, the pen is connectable to the pen holder of the present invention by a cord or chain, which passes through the elongated hole 20. On the base 1, images, logos or other information are printable, giving the present invention an interesting and informative appearance.

Of the present invention, one embodiment has been described. Further variations are possible, like a base of rectangular, polygonal or star-like shape, or an insertion part of another geometrical shape. Such varations are within the scope of the present invention, as defined in the claims below.

What is claimed is:

1. A pen holder for holding a pen vertically or horizontally, comprising:

a base, including an upper part, shaped like a circular pan turned upside down, having a concentric hole and a periphery, and a lower part, shaped like a circular pan, with a bottom and a periphery, with a hollow, concentric shaft extending upwards from said bottom, said shaft having a top side, which is open, said lower part having a plurality of upward extending radial ribs on said bottom, said periphery of said upper part being attached to said periphery of said lower part;

an insertion part, vertically rotatably mounted on said base, said insertion part being made of two halves, each of said halves further comprising a half plate with an upper side and a horizontal longitudinal axis, and a quarter ball, attached to said upper side of said half plate, with a polar axis parallel to said longitudinal axis and a concave side opposite thereto, wherein said longitudinal axes of said two halves coincide and wherein said two halves both have guiding parts for gliding against each other along said longitudinal axes and are oriented in a way that said concave sides of quarter balls face each other; and two springs, each of said two springs mounted on one of said halves, pressing against said periphery of said lower part, such that said two halves of said insertion part are pressed together, leaning against each other.

2. A pen holder according to claim 1, wherein for each of said halves with one of said springs a holding part is provided for holding said spring and an opening where said spring passes through.

3. A pen holder according to claim 1, wherein for each of said halves said half plate has a peripheral edge having a straight section with a first end and a second end, with a rail on said first end and a guiding groove on said second end extending downward from said upper side of said half plate, such that for each of said half plates said rail glides in said guiding groove of the other of said half plates.

4. A pen holder according to claim 1, wherein for each of said halves said half plate close to said rail has a downward extending lower extension.

5. A pen holder according to claim 1, wherein for each of said halves from said rail an elastic protrusion extends down between two of said radial ribs, wherein, when said insertion part rotates, said elastic protrusions pass over said radial ribs, producing a noticeable sound.

6. A pen holder according to claim 1, wherein for each of said halves said quarter ball on said concave side has a vertical groove and a horizontal groove.

7. A pen holder according to claim 1, wherein said base and said insertion part have contours, which are not round.

8. A pen holder according to claim 1, wherein between said half balls, when pressed together, a channel of rectangular or polygonal cross-section or of conical shape is left.

* * * * *

UNITED STATES PATENT AND TRADEMARK OFFICE

CERTIFICATE OF CORRECTION

PATENT NO. : 5,839,712

DATED : November 24, 1998

INVENTOR(S) : Chin-Chi Wang

It is certified that error appears in the above-identified patent and that said Letters Patent is hereby corrected as shown below:

Column 2, line 17, change "half"(third occurence) to --quarter--.

Column 2, line 23, change "half"(second occurrence) to --quarter--.

Column 2, line 34, change "half" to --quarter--.

Column 2, line 35, change "half" to --quarter--.

Colum 2, line 37, change "half" to --quarter--.

Column 2, line 38, change "half"(first occurrence) to --quarter--.

Column 2, line 42, change "half" to --quarter--.

Column 3, line 2, change "half" to --quarter--.

Signed and Sealed this

Ninth Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,839,712
DATED : November 24, 1998
INVENTOR(S) : Chin-Chi WANG

It is certified that error appears in the above-indentified patent and that said Letters Patent is hereby corrected as shown below:

Column 2, line 23,
Page 4, line 7, delete "half" (second occurrence) and insert therefore - -quarter- -.

Column 2, line 56,
Page 5, line 14, delete "half" and insert therefore - -quarter- -.

Signed and Sealed this

Thirtieth Day of March, 1999

*Attest:*

*Attesting Officer*

Q. TODD DICKINSON

*Acting Commissioner of Patents and Trademarks*